US010216107B2

(12) United States Patent
Tsubaki et al.

(10) Patent No.: US 10,216,107 B2
(45) Date of Patent: Feb. 26, 2019

(54) TONER AND METHOD OF PRODUCING TONER

(71) Applicant: CANON KABUSHIKI KAISHA, Tokyo (JP)

(72) Inventors: Keiichiro Tsubaki, Numazu (JP); Naoya Isono, Suntou-gun (JP); Yasuaki Murai, Numazu (JP); Masao Suzuki, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/856,218

(22) Filed: Dec. 28, 2017

(65) Prior Publication Data

US 2018/0196367 A1 Jul. 12, 2018

(30) Foreign Application Priority Data

Jan. 11, 2017 (JP) ..... 2017-002749
Dec. 12, 2017 (JP) ..... 2017-237606

(51) Int. Cl.
*G03G 9/087* (2006.01)
*G03G 9/08* (2006.01)
*G03G 9/09* (2006.01)

(52) U.S. Cl.
CPC ..... *G03G 9/0806* (2013.01); *G03G 9/0819* (2013.01); *G03G 9/08711* (2013.01); *G03G 9/08782* (2013.01); *G03G 9/0918* (2013.01)

(58) Field of Classification Search
CPC ..... G03G 9/08706; G03G 9/08708; G03G 9/08711; G03G 9/08782; G03G 9/08797
See application file for complete search history.

(56) References Cited

U.S. PATENT DOCUMENTS

| | | | |
|---|---|---|---|
| 7,141,342 | B2 | 11/2006 | Toyoda et al. |
| 7,288,357 | B2 | 10/2007 | Toyoda et al. |
| 7,833,685 | B2 | 11/2010 | Tanaka et al. |
| 8,211,606 | B2 | 7/2012 | Murai et al. |
| 8,367,289 | B2 | 2/2013 | Isono et al. |
| 8,377,616 | B2 | 2/2013 | Tani et al. |
| 8,440,382 | B2 | 5/2013 | Isono et al. |
| 8,497,054 | B2 | 7/2013 | Sugiyama et al. |
| 8,628,899 | B2 | 1/2014 | Kawamura et al. |
| 8,652,737 | B2 | 2/2014 | Handa et al. |
| 8,778,581 | B2 | 7/2014 | Nonaka et al. |
| 8,815,484 | B2 | 8/2014 | Tanaka et al. |
| 9,158,216 | B2 | 10/2015 | Shinano et al. |
| 9,377,705 | B2 | 6/2016 | Shimano et al. |
| 9,383,668 | B2 | 7/2016 | Noji et al. |
| 9,500,972 | B2 | 11/2016 | Tanaka et al. |
| 9,556,290 | B2 | 1/2017 | Nishiura et al. |
| 9,575,424 | B2 | 2/2017 | Nakagawa et al. |
| 9,599,919 | B2 | 3/2017 | Isono et al. |
| 9,658,549 | B2 | 3/2017 | Tanaka et al. |
| 9,715,187 | B2 | 7/2017 | Makumoto et al. |
| 9,785,071 | B2 | 10/2017 | Shimano et al. |
| 9,829,814 | B2 | 11/2017 | Yoshida et al. |
| 9,829,816 | B2 | 11/2017 | Tanaka et al. |
| 9,835,964 | B2 | 12/2017 | Yoshida et al. |
| 2005/0209364 | A1 | 9/2005 | Yamagishi et al. |
| 2013/0202998 | A1 | 8/2013 | Higashi et al. |
| 2013/0244157 | A1* | 9/2013 | Inoue ..... G03G 9/0812 430/105 |
| 2014/0356779 | A1 | 12/2014 | Hasegawa et al. |
| 2014/0377697 | A1 | 12/2014 | Nishiura et al. |
| 2016/0334727 | A1 | 11/2016 | Tanaka et al. |
| 2017/0060011 | A1 | 3/2017 | Nakagawa et al. |
| 2017/0160658 | A1 | 6/2017 | Nakagawa et al. |
| 2017/0293235 | A1 | 10/2017 | Tagawa et al. |

FOREIGN PATENT DOCUMENTS

| | | |
|---|---|---|
| JP | 2002-108015 A | 4/2002 |
| JP | 2016-114826 A | 6/2016 |

OTHER PUBLICATIONS

U.S. Appl. No. 15/814,818, Masao Suzuki, filed Nov. 16, 2017.
Fedors, "A Method for Estimating Both the Solubility Parameters and Molar Volumes of Liquids", Poly. Eng. Sci., vol. 14, No. 2 (1974) 147-54.

* cited by examiner

*Primary Examiner* — Peter L Vajda
(74) *Attorney, Agent, or Firm* — Venable LLP

(57) ABSTRACT

Provided is a toner having a toner particle that contains a binder resin and a wax, wherein the solubility parameter $S_P$ of the binder resin is at least 9.4 and not more than 10.0; the binder resin contains a resin having a structure represented by the following formula (1) in the terminal position on a main chain of the resin, $$*\text{—CO—R} \qquad \text{formula (1)}$$

(in formula (1), R represents a phenyl group or a derivative thereof, or —$COOR_1$, $R_1$ represents an alkyl group having 1 to 4 carbons, and * represents a bond to the main chain of the resin); the solubility parameter $S_W$ of the wax is at least 8.1 and not more than 9.0; and $S_P$ and $S_W$ satisfy formula (2), $$|S_P - S_W| > 0.5 \qquad \text{formula (2).}$$

11 Claims, No Drawings

TONER AND METHOD OF PRODUCING TONER

BACKGROUND OF THE INVENTION

Field of the Invention

The present invention relates to a toner used to form a toner image by the development of an electrostatic latent image formed by a method such as an electrophotographic method, electrostatic recording method, or toner jet system recording method. The present invention further relates to a method of producing this toner.

Description of the Related Art

Due to advances in computers and multimedia, there has been desire in recent years, over a broad range of fields from office settings to the home, for means for printing full-color images at higher definitions. As a consequence, there is also demand for higher environmental stability characteristics required of toners over a diverse range of uses and storage environments on the user side. On the other hand, there is also strong demand for higher speeds due to increasing print volumes and a broadening of the fixable range for toners is thus required.

As a consequence, the fixability on the lower temperature side (cold offset resistance) and the fixability on the higher temperature side (hot offset resistance) must be improved, and this can be achieved by controlling the affinity between the binder resin and release agent. However, while lowering the affinity between the binder resin and release agent, i.e., increasing the polarity of the binder resin, in order to improve the hot offset resistance is generally known, the actual situation is that this cannot be regarded as satisfactorily coexisting with the charging stability in high-temperature, high-humidity environments.

Subject matter related to a toner having an excellent hot offset resistance and an excellent suppression of fogging (charging stability) at high temperatures and high humidities is disclosed in Japanese Patent Application Laid-open No. 2016-114826. The hot offset resistance is raised by a polyester resin that, while readily assuming a high molecular weight, has a high hydrophilicity, and the resin surface of the toner is efficiently hydrophobed by using a hydrocarbon wax in combination with a highly hydrophobic crystalline composite resin and raising the dispersibility. As a consequence of this, through a suppression of fogging at high temperatures and high humidities, coexistence is brought about between the hot offset resistance and the charging stability in high-temperature, high-humidity environments.

In addition, controlling the molecular weight distribution of the resin in toners is a method for improving the adhesiveness to transfer materials in fixing methods such as heated roller and film.

With regard to toner production methods in which the toner particle is obtained by the polymerization of polymerizable monomer in an aqueous medium, a method that has been proposed for controlling the resin molecular weight distribution is control using α-methylstyrene dimer (MSD) chain transfer agent or a mercaptan-type chain transfer agent. However, considering these chain transfer agents, the former brings the problem of a decline, which depends on its amount of addition, in the conversion of the polymerizable monomer. With the latter, on the other hand, odor originating with the mercapto group is present and the problem occurs of odor generation during thermal fixation. A method is proposed in Japanese Patent Application Laid-open No. 2002-108015 with regard to this problem with the latter chain transfer agent, wherein the odor is suppressed by adding a deodorant during the washing step.

SUMMARY OF THE INVENTION

However, with regard to the art in Japanese Patent Application Laid-open No. 2016-114826, it is thought that the hot offset resistance does not satisfactorily coexist with the charging stability in high-temperature, high-humidity environments because a complex resin design is required and, due to functional separation over multiple resins, it is difficult to control the localization of the individual resins in the toner.

With regard to the art described in Japanese Patent Application Laid-open No. 2002-108015, while it does solve the odor problem, a special step must be provided and a lengthy period of time is required for washing. In addition, it entails a large burden for treatment of the wastewater that is the used wash liquid and room for improvement thus still remains.

A first object of the present invention is to solve the problems described above. That is, a first object of the present invention is to provide a toner that exhibits an excellent hot offset resistance and that also exhibits an excellent charging stability in high-temperature, high-humidity environments.

A second object of the present invention is to provide a method of producing an odor-inhibited toner whereby a binder resin having a regulated molecular weight is obtained without reducing the conversion.

A first aspect of the present invention relates to a toner having a toner particle that contains a binder resin and a wax, wherein the solubility parameter $S_P$ of the binder resin is at least 9.4 and not more than 10.0;

the binder resin contains a resin having a structure represented by the following formula (1) in the terminal position on a main chain of the resin, $$*\text{—CO—R} \qquad \text{formula (1)}$$

(in formula (1), R represents a phenyl group or a derivative thereof, or —$COOR_1$, $R_1$ represents an alkyl group having 1 to 4 carbons, and * represents a bond to the main chain of the resin);

the solubility parameter $S_W$ of the wax is at least 8.1 and not more than 9.0; and $S_P$ and $S_W$ satisfy formula (2).

$$|S_P - S_W| > 0.5 \qquad \text{formula (2)}$$

A second aspect of the present invention relates to a method of producing a toner having a toner particle that contains a binder resin, the method including:

a step of dispersing, in an aqueous medium, a polymerizable monomer composition containing a chain transfer agent, a polymerization initiator, and a polymerizable monomer capable of forming the binder resin, to form a liquid droplet of the polymerizable monomer composition; and a step of producing a toner particle by polymerizing the polymerizable monomer in the liquid droplet, wherein the polymerizable monomer contains at least one selected from the group consisting of styrene, acrylate esters, and methacrylate esters and the chain transfer agent is a vinyl ether addition-fragmentation chain transfer agent represented by formula (3)

(in formula (3), $R_2$ represents —$COOR_1$ or the phenyl group or a derivative thereof, $R_1$ represents an alkyl group having 1 to 4 carbons, and $R_3$ represents the benzyl group or a secondary or tertiary alkyl group having 4 to 8 carbons).

(3)

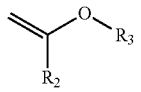

Further features of the present invention will become apparent from the following description of exemplary embodiments.

DESCRIPTION OF THE EMBODIMENTS

Unless specifically indicated otherwise, phrases such as "at least XX and not more than YY" and "XX to YY" that specify a numerical value range indicate in the present invention a numerical value range that includes the lower limit and upper limit that are the endpoints.

The affinity between the binder resin and wax is preferably lowered, i.e., a polar group is preferably introduced into the binder resin, in order to improve the hot offset resistance during fixation. However, raising the polarity of the binder resin causes a destabilization of the charging stability in high-temperature, high-humidity environments.

In view of this, the present inventors carried out intensive investigations focusing on the molecular structure of the binder resin and the relationship between the solubility parameter of the binder resin and the solubility parameter of the wax. As a result, a special structure was incorporated as a molecular structure in the binder resin and a correlation in the solubility parameter values of the binder resin and wax was discovered and the present invention was thereby achieved.

That is, for a toner having a toner particle that contains a binder resin and a wax, it was discovered that the hot offset resistance during fixation could be made to coexist with the charging stability in high-temperature, high-humidity environments when the solubility parameter $S_P$ of the binder resin is at least 9.4 and not more than 10.0, the binder resin contains a resin having a structure represented by the following formula (1) in the terminal position on a main chain of the resin, the solubility parameter $S_W$ of the wax is at least 8.1 and not more than 9.0, and $S_P$ and $S_W$ satisfy formula (2).

The solubility parameter is a parameter that indicates that species with similar values readily exhibit affinity for each other, and the solubility parameter used in the present invention can be calculated by the generally used Fedors method (Poly. Eng. Sci., 14(2) 147 (1974)) from the species and molar ratio of the constituent monomers.

The unit for the SP value in the present invention is $(cal/cm^3)^{1/2}$, but this can be converted to the $(J/m^3)^{1/2}$ unit using 1 $(cal/cm^3)^{1/2}=2.046\times10^3$ $(J/m^3)^{1/2}$.

*—CO—R formula (1)

(In formula (1), R represents a phenyl group or a derivative thereof, or —$COOR_1$, $R_1$ represents an alkyl group having 1 to 4 carbons, and * represents a bond to the main chain of the resin.)

$|S_P-S_W|>0.5$ formula (2)

The reasons that the effects of the present invention are yielded by a toner that satisfies the aforementioned conditions are thought by the present inventors to be as follows.

A characteristic feature of the present invention is that the binder resin contains resin that has the polar group represented by formula (1) in the terminal position on a main chain of the resin. A feature called the terminal group effect is known to exist, wherein a large effect on the thermal properties of a resin is exercised by the structure of the main chain terminal group in the polymer constituting the resin. The cause for this is thought to be that the terminal moiety of the main chain has a higher mobility than the side chains and it can thus interact more easily with other polymer chains.

The improvement in the hot offset resistance in the present invention due to the incorporation of a binder resin having the aforementioned terminal group structure and a wax is thought to occur due to the large influence of the aforementioned terminal group effect in addition to the release effect from the wax brought about because the difference in the solubility parameters between the binder resin and wax satisfies formula (2).

The materials used in the present invention are described in the following.

<Binder Resin>

The binder resin characteristically contains a resin that has a structure represented by the following formula (1) in the terminal position on a main chain of the resin.

*—CO—R formula (1)

(In formula (1), R represents —$COOR_1$, $R_1$ represents an alkyl group having 1 to 4 carbons or a phenyl group or a derivative thereof, and * represents a bond to the main chain of the resin.)

Within the structure of R, $R_1$ can be exemplified by the methyl group, ethyl group, n-propyl group, isopropyl group, n-butyl group, isobutyl group, and t-butyl group.

The derivatives of the phenyl group can be exemplified by substituent-bearing phenyl groups. The substituent can be exemplified by at least one selected from the group consisting of the methyl group, ethyl group, n-propyl group, isopropyl group, n-butyl group, isobutyl group, t-butyl group, methoxy group, and ethoxy group. —$COOCH_3$ and the phenyl group are preferred for the structure of R.

The abundance of the formula (1) structure in the binder resin is preferably at least 5% and not more than 100%.

The designation of 100% for the abundance of this formula (1) structure indicates that at least one of the main chain terminal structures in the binder resin is entirely the formula (1) structure (keto group).

When the abundance of the formula (1) structure is brought into the indicated range in a toner for which the solubility parameter $S_P$ of the binder resin is at least 9.4 and not more than 10.0, the solubility parameter $S_W$ of the wax is at least 8.1 and not more than 9.0, and $S_P$ and $S_W$ satisfy the aforementioned formula (2), the proportion of the polar group terminal-bearing binder resin in the binder resin then becomes sufficient to obtain a wax outmigration effect that originates with the terminal group effect of the polar group.

The abundance of the main chain terminal structure represented by formula (1) in the binder resin is more preferably at least 5% and not more than 70%. The charging stability is improved by this.

In order to bring the abundance of the formula (1) structure into the indicated range, the method for introducing the main chain terminal structure preferably uses a polymer reaction, a polymerization termination reaction, or a chain transfer reaction.

When a polymer reaction is used, the main chain terminal position of the binder resin is preliminarily made, for example, into a highly reactive hydroxyl group or carboxyl group, and the formula (1) structure can then be introduced by reaction with a compound that will provide the formula (1) structure.

When a polymerization termination reaction or a chain transfer reaction is used, the formula (1) structure can be introduced during polymerization of the binder resin through the use of a polymerization terminator or chain transfer agent that upon reaction will provide the formula (1) structure.

Of these methods of introduction, the use of the reaction of a chain transfer agent is preferred when the binder resin is produced by radical polymerization. The use of a chain transfer reaction is not accompanied by a decline in the conversion depending on the type and molecular structure of the chain transfer agent used. Moreover, the rate of the chain transfer reaction can be controlled through the value of the chain transfer coefficient of the chain transfer agent used. The formula (1) structure can be efficiently introduced through a combination of the species, structure, and chain transfer coefficient of the chain transfer agent in correspondence to conditions such as the species of polymerizable monomer used for binder resin production, the type of radical polymerization used, and the presence/absence of a solvent.

Another characteristic feature of the present invention is that the solubility parameter $S_P$ of the binder resin is at least 9.4 and not more than 10.0. The present inventors discovered that the hot offset resistance and the charging stability in high-temperature, high-humidity environments are particularly excellent when the binder resin contains a resin having the formula (1) structure in the terminal position on a main chain of the resin and the $S_P$ of the binder resin is in the range indicated above. The $S_P$ of the binder resin must be in the indicated range in order to bring about an efficient expression of the terminal group effect originating with the presence of the highly polar keto group terminals as noted above.

The specification that the solubility parameter $S_P$ of the binder resin is in the range of at least 9.4 and not more than 10.0 indicates that the resin has properties near to hydrophobicity. That is, the binder resin preferably has a resin structure constituted mainly of hydrophobic styrene, acrylic acid, or methacrylic acid, and so forth. $S_P$ is more preferably at least 9.4 and not more than 9.8.

Thus, by having the keto group structure represented by formula (1) in the terminal position on the main chain of the binder resin and by having the solubility parameter $S_P$ of the binder resin be at least 9.4 and not more than 10.0, a good balance is reached between the hydrophobicity of the binder resin, which contributes to the affinity between the binder resin and wax, and the polarity of the binder resin, which contributes to the charging stability in high-temperature, high-humidity environments. As a result, an excellent effect is exhibited on the hot offset resistance and the charging stability in high-temperature, high-humidity environments.

The binder resin preferably contains a vinyl resin. That is, the main chain of the resin having the formula (1) structure in terminal position is preferably a vinyl resin. Vinyl resin is a collective term for resins obtained from vinyl group-bearing polymerizable monomer using a known radical polymerization method and can be exemplified by styrene resins, acrylic resins, methacrylic resins, styrene-acrylic resins, and styrene-methacrylic resins.

The polymerizable monomer constituting the vinyl resin may be a single monofunctional polymerizable monomer having one vinyl group, or a combination of two or more thereof, or may be a combination of a monofunctional polymerizable monomer with a polyfunctional polymerizable monomer having a plurality of vinyl groups, or may be a single polyfunctional polymerizable monomer or a combination of two or more thereof.

Within a range in which the effects of the present invention are not impaired, the binder resin may contain a resin other than the resin having the formula (1) structure in the terminal position on a main chain of the resin.

The monofunctional polymerizable monomer can be exemplified by the following: styrene and styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

acrylate esters such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; and methacrylate esters such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

The polyfunctional polymerizable monomer can be exemplified by diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl) propane, trimethylolpropane trimethacrylate, tetramethylolmethane tetramethacrylate, divinylbenzene, divinylnaphthalene, and divinyl ether.

The polymerizable monomer is preferably at least one selected from the group consisting of styrene, acrylate esters, and methacrylate esters.

<Wax>

A characteristic feature for the present invention is that the solubility parameter $S_W$ of the wax is at least 8.1 and not more than 9.0. The present inventors discovered that—by incorporating a wax having a solubility parameter $S_W$ in the indicated range and incorporating a resin having the formula (1) keto group structure in the terminal position on the main chain of a binder resin for which $S_P$ is in the indicated range—an excellent affinity balance between the wax and binder resin is then assumed and the wax outmigration effect during fixation can be improved. A known wax can be used without particular limitation as long as it has a solubility parameter in the indicated range; however, hydrocarbon waxes and ester waxes are preferred. $S_W$ is preferably at least 8.3 and not more than 8.9.

The following, for example, can be used as the hydrocarbon wax: polyolefin produced as the low molecular weight by-product obtained during the polymerization of high molecular weight polyolefin; polyolefin provided by polymerization using a catalyst such as a Ziegler catalyst or metallocene catalyst; paraffin waxes and Fischer-Tropsch waxes; synthetic hydrocarbon waxes as synthesized by the Synthol method, Hydrocol method, or Arge method from a coal gas or natural gas starting material; synthetic waxes for which the monomer is a compound having one carbon; hydrocarbon waxes bearing a functional group such as the hydroxyl group or carboxyl group; and mixtures of hydrocarbon waxes and functional group-bearing hydrocarbon waxes. Also usable are hydrocarbon waxes as provided by sharpening the molecular weight distribution of the preceding waxes using a method such as a press sweating method, solvent method, recrystallization method, vacuum distillation, supercritical gas extraction method, or a fractional crystallization technique, and hydrocarbon waxes provided by the removal of low molecular weight solid fatty acids, low molecular weight solid alcohols, low molecular weight solid compounds, and other impurities.

The ester wax should have at least one ester bond in each molecule, and either a natural wax or a synthetic wax may be used.

Synthetic ester waxes can be exemplified by esters between a linear aliphatic acid and a linear aliphatic monoalcohol, and a monoester wax synthesized from a long-chain linear saturated fatty acid and a long-chain linear saturated monoalcohol is preferred. The long-chain linear saturated fatty acid used preferably has the general formula $C_nH_{(2n+1)}COOH$ wherein n=5 to 28. The long-chain linear saturated monoalcohol used is preferably represented by $C_nH_{(2n+1)}OH$ wherein n=5 to 28.

The long-chain linear saturated fatty acid can be specifically exemplified by capric acid, undecanoic acid, lauric acid, tridecanoic acid, myristic acid, palmitic acid, pentadecanoic acid, heptadecanoic acid, tetradecanoic acid, stearic acid, nonadecanoic acid, arachidic acid, behenic acid, lignoceric acid, cerotic acid, heptacosanoic acid, montanic acid, and melissic acid.

The long-chain linear saturated monoalcohol can be specifically exemplified by amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptacosanol.

Ester waxes having two or more ester bonds in each molecule can be exemplified by ester waxes having from two to eight ester bonds, i.e., esters between an aliphatic monocarboxylic acid and a dihydric to octahydric alcohol and esters between an aliphatic monoalcohol and a dibasic to octabasic carboxylic acid.

Specific examples are trimethylolpropane tribehenate, pentaerythritol tetrabehenate, pentaerythritol diacetate dibehenate, glycerol tribehenate, 1,18-octadecanediol bisstearate, and so forth; and polyalkanol esters (tristearyl trimellitate, distearyl maleate).

The molecular weight of the wax is preferably not more than 2,500 and is more preferably not more than 2,000. When the molecular weight of the wax is in the indicated range, the molecular size (breadth of the molecular chain) is then not too large and due to this the diffusion rate can be held to at least a certain level and wax outmigration during fixation is facilitated. While there is no particular limit on the lower limit, at least 300 is preferred.

The content of the wax in the toner particle is preferably at least 1 mass % and not more than 30 mass %. When the wax content is in the indicated range, the wax then assumes a favorable proportion in the toner as a whole and due to this an excellent fixing effect is readily obtained during toner fixation.

The melting point of the wax is preferably at least 60° C. and not more than 120° C. and more preferably at least 65° C. and not more than 100° C.

Only a single species of wax may be used in the toner or a combination of a plurality of species may be used.

The solubility parameter $S_P$ of the binder resin and the solubility parameter $S_W$ of the wax satisfy formula (2) in the present invention.

$$|S_P - S_W| > 0.5 \quad \text{formula (2)}$$

An excellent wax outmigration effect is readily obtained during fixation when $S_P$ and $S_W$ are in the range as indicated above and the absolute value of the difference between $S_P$ and $S_W$ is in the indicated range.

The basis for this is as follows: in order for the release effect from the wax to be produced during toner fixation, the balance for the affinity between the binder resin and wax must not be overly biased to the affinity side, i.e., the absolute value of the difference in the solubility parameters must be at least a certain value.

$|S_P - S_W|$ is preferably at least 1.0. The upper limit, on the other hand, is not particularly limited, but is preferably not more than 2.0 and more preferably not more than 1.5.

<Other Additives>

Besides the binder resin and wax, various additives may also be added to the toner particle on an optional basis. Typical examples of these additives are provided in the following.

<Colorant>

A colorant may be used in the toner. The following may be used as a black colorant: carbon black, a magnetic body, and black colorants provided by color mixing to yield a black color using the yellow/magenta/cyan colorants given in the following.

The yellow colorants can be exemplified by compounds as represented by condensed azo compounds, isoindolinone compounds, anthraquinone compounds, azo metal complexes, methine compounds, and arylamide compounds. Specific examples are C. I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214.

The magenta colorant can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples are C. I. Pigment Red 2, 3, 5, 6, 7, 23, 48:2, 48:3, 48:4, 57:1, 81:1, 122, 146, 150, 166, 169, 177, 184, 185, 202, 206, 220, 221, 238, 254, and 269 and C. I. Pigment Violet 19.

The cyan colorant can be exemplified by copper phthalocyanine compounds and derivatives thereof, anthraquinone compounds, and basic dye lake compounds. Specific examples are C. I. Pigment Blue 1, 7, 15, 15:1, 15:2, 15:3, 15:4, 60, 62, and 66.

A single one of these colorants may be used or a mixture may be used and these colorants may also be used in a solid solution state. The colorant is selected considering the hue angle, chroma, lightness, lightfastness, OHP transparency, and dispersibility in the toner. The amount of colorant addition is preferably at least 1 mass parts and not more than 20 mass parts per 100 mass parts of the binder resin or the polymerizable monomer capable of forming the binder resin.

A magnetic toner can also be provided by incorporating a magnetic material as colorant. In this case the magnetic material can also function as the colorant. The magnetic material can be exemplified by the following: iron oxides such as magnetite, hematite, and ferrite; metals such as iron, cobalt, and nickel; and alloys of these metals with a metal such as aluminum, cobalt, copper, lead, magnesium, tin, zinc, antimony, beryllium, bismuth, cadmium, calcium, manganese, cerium, titanium, tungsten, or vanadium, and their mixtures.

The aforementioned magnetic body is more preferably a surface-modified magnetic body. When the magnetic toner is prepared by a polymerization method, preferably a hydrophobic treatment is executed on the magnetic body using a surface modifier that does not inhibit the polymerization. This surface modifier can be exemplified by silane coupling agents and titanium coupling agents.

The number-average particle diameter of the magnetic body is preferably not more than 2 μm and is more preferably at least 0.1 μm and not more than 0.5 μm. The content in the toner particle, per 100 mass parts of the binder resin or polymerizable monomer capable of forming the binder resin, is preferably at least 20 mass parts and not more than 200 mass parts and is more preferably at least 40 mass parts and not more than 150 mass parts.

<Charge Control Agent>

A charge control agent may be incorporated in the toner in order to stabilize the charging characteristics. A known charge control agent can be used as the charge control agent, and in particular a charge control agent is preferred that can provide a fast charging speed and that can stably maintain a certain charge quantity. Moreover, when the toner is produced by a direct polymerization method, a charge control agent is particularly preferred that exercises little inhibition of the polymerization and that is substantially free of material soluble in the aqueous dispersion medium.

Examples of specific compounds for negative-charging charge control agents are as follows: metal compounds of aromatic carboxylic acids, e.g., salicylic acid, alkylsalicylic acid, dialkylsalicylic acid, naphthoic acid, and dicarboxylic acids; metal salts and metal complexes of azo dyes and azo pigments; and boron compounds, silicon compounds, and calixarene. Positive-charging charge control agents can be exemplified by quaternary ammonium salts, polymeric compounds having the quaternary ammonium salt in side chain position, guanidine compounds, nigrosine compounds, and imidazole compounds.

The amount of use of these charge control agents is determined by the type of binder resin, the presence/absence of other additives, and the toner production method including the dispersion method, and thus cannot be strictly limited. In the case of internal addition, at least 0.1 mass parts and not more than 10 mass parts is preferred and at least 0.1 mass parts and not more than 5 mass parts is more preferred, in each case per 100 mass parts of the binder resin or polymerizable monomer. In the case of external addition, at least 0.005 mass parts and not more than 1.0 mass part is preferred and at least 0.01 mass parts and not more than 0.3 mass parts is more preferred, in each case per 100 mass parts of the toner particle.

<Chain Transfer Agent>

The present inventors also discovered that the hot offset resistance during fixation and the charging stability in high-temperature, high-humidity environments are improved by a toner production method that includes a step of obtaining the binder resin by polymerizing a polymerizable monomer composition containing a polymerization initiator, a polymerizable monomer, and a vinyl ether addition-fragmentation chain transfer agent represented by formula (3).

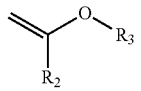

(3)

(In formula (3), $R_2$ represents —$COOR_1$ or the phenyl group or a derivative thereof, $R_1$ represents an alkyl group having 1 to 4 carbons, and $R_3$ represents the benzyl group or a secondary or tertiary alkyl group having 4 to 8 carbons.)

This chain transfer agent is a chain transfer agent having the vinyl ether represented by formula (3) for its skeleton. In order to exhibit an efficient chain transfer reaction in a radical polymerization field, the $R_2$ in formula (3) must be —$COOR_1$, $R_1$ represents an alkyl group having 1 to 4 carbons or the phenyl group or a derivative thereof. When this structure is adopted, an efficient chain transfer reaction is exhibited with the polymerizable monomer.

$R_1$ can be exemplified by the methyl group, ethyl group, n-propyl group, isopropyl group, n-butyl group, isobutyl group, and t-butyl group.

The derivatives of the phenyl group can be exemplified by substituent-bearing phenyl groups, wherein the substituent is, for example, at least one selected from the group consisting of the methyl group, ethyl group, n-propyl group, isopropyl group, n-butyl group, isobutyl group, t-butyl group, methoxy group, and ethoxy group.

$R_2$ is more preferably —$COOCH_3$ or the phenyl group or a derivative thereof.

In addition, this chain transfer agent is an addition-fragmentation chain transfer agent. The occurrence of a reduction in the polymerization conversion is suppressed by the efficient addition to the polymerizable monomer of the initiation radical produced from addition and fragmentation.

Due to this, $R_3$ must be the benzyl group or a secondary or tertiary alkyl group having 4 to 8 carbons. This secondary or tertiary alkyl group having 4 to 8 carbons can be exemplified by the isobutyl group, tert-butyl group, and tert-amyl group.

$R_3$ is more preferably the benzyl group, isobutyl group, or tert-butyl group.

The chain transfer agent can be exemplified by α-benzyloxystyrene, isobutyloxystyrene, t-butyloxystyrene, benzyloxy-p-methylstyrene, benzyloxy-p-methoxystyrene, methyl 2-benzyloxyacrylate, ethyl 2-benzyloxyacrylate, n-butyl 2-benzyloxyacrylate, t-butyl 2-benzyloxyacrylate, methyl 2-isobutyloxyacrylate, and methyl 2-t-butyloxyacrylate.

This chain transfer agent is also preferably at least one selected from the group consisting of formulas (4) to (6).

(4)

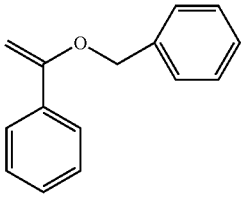

(5)

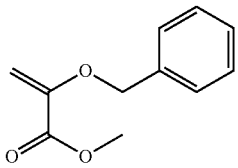

(6)

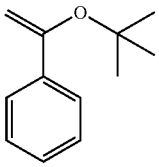

The amount of addition of the chain transfer agent represented by formula (3), per 100.0 mass parts of the polymerizable monomer, is preferably at least 0.1 mass parts and not more than 5.0 mass parts and is more preferably at least 0.3 mass parts and not more than 4.5 mass parts. Control of the polymerization in terms of, for example, the amount of low molecular component and reductions in the polymerization conversion, is facilitated when the amount of addition is in the indicated range, which as a consequence facilitates obtaining a resin having a regulated molecular weight distribution. In addition, the occurrence of excessively large residual amounts of, e.g., unreacted material, at the completion of polymerization can be suppressed by having the amount of addition be in the indicated range.

<Polymerization Initiator>

The polymerization initiator that can be used in the polymerizable monomer composition can be exemplified by the known organoperoxide initiators and azo compound initiators. The following are examples of the organoperoxide initiators:

alkyl peroxyesters such as t-butyl peroxypivalate and t-amyl peroxypivalate, peroxymonocarbonates such as t-amylperoxy isopropyl carbonate, peroxyketals such as 1,1-di (t-amylperoxy)cyclohexane, dialkyl peroxides such as di-t-butyl peroxide and di-t-amyl peroxide, diacyl peroxides such as diisononanoyl peroxide and diisobutyryl peroxide, and peroxydicarbonates such as bis(4-t-butylcyclohexyl) peroxy dicarbonate.

The azo compound initiator can be exemplified by 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobismethylbutyronitrile, and 1,1'-azobis(1-acetoxy-1-phenylethane).

The polymerization initiator is preferably an alkyl peroxyester organoperoxide, diacyl peroxide organoperoxide, or an azo compound.

The organoperoxide initiators and azo compound initiators may be used as such as a single species or may be used as a mixture of a plurality of species.

A preferred toner production method includes a step of obtaining the binder resin by carrying out the polymerization of a polymerizable monomer composition that contains a polymerization initiator, polymerizable monomer, and the vinyl ether addition-fragmentation chain transfer agent represented by formula (3). Examples are known production methods that use a binder resin produced in advance and known production methods that produce a toner particle via the aforementioned radical polymerization step. For example, dry production methods, emulsion aggregation methods, dissolution suspension methods, and suspension polymerization methods are preferred.

The steps included in the production method of the present invention are described in the following.

<Step of Obtaining Binder Resin by Polymerization of Polymerizable Monomer Composition>

The toner production method of the present invention preferably includes a step of obtaining the binder resin by polymerizing a polymerizable monomer composition that contains a polymerization initiator, a polymerizable monomer, and a vinyl ether addition-fragmentation chain transfer agent represented by formula (3).

The main chain terminal structure can be efficiently controlled by using the chain transfer agent as described above during polymerization.

Here, after a radical has added to the vinyl ether addition-fragmentation chain transfer agent represented by formula (3), the initiation radical fragments and at this time the radical growth end produces the keto group. As described in the preceding section on the chain transfer agent, by adopting the structure represented by formula (3), the terminal keto group can be efficiently introduced while minimizing reductions in the conversion during the polymerization of styrene and acrylic or methacrylic polymerizable monomer.

The following production method can be favorably used for the second aspect of the present invention:

a method of producing a toner having a toner particle that contains a binder resin, the method including:

a step of dispersing, in an aqueous medium, a polymerizable monomer composition containing a chain transfer agent, a polymerization initiator, and a polymerizable monomer capable of forming the binder resin, to form a liquid droplet of the polymerizable monomer composition, and a step of producing a toner particle by polymerizing the polymerizable monomer in the liquid droplet, wherein the polymerizable monomer contains at least one selected from the group consisting of styrene, acrylate esters, and methacrylate esters and the chain transfer agent is a vinyl ether addition-fragmentation chain transfer agent represented by formula (3).

The present inventors discovered that, by using a chain transfer agent represented by formula (3) in toner particle production by the suspension polymerization method, an efficient chain transfer reaction is exhibited in the suspension polymerization field and a binder resin having a regulated molecular weight is obtained without lowering the conversion. It was also discovered that the odor is suppressed in the obtained toner particle.

When the chain transfer agent has the indicated structure, an efficient chain transfer reaction is exhibited with respect to styrene, acrylate esters, and methacrylate esters. In addition, this chain transfer agent is an addition-fragmentation chain transfer agent, and the occurrence of reductions in the polymerization conversion is suppressed due to the efficient addition of the initiation radical—produced from addition and fragmentation—to the polymerizable monomer.

This chain transfer agent is a chain transfer agent that has a vinyl ether for its skeleton. This vinyl ether addition-fragmentation chain transfer agent does not have a functional group, e.g., the mercapto group, that is a source of odor, and as a consequence an odor-inhibited binder resin is obtained without having to execute a special step.

The suspension polymerization method is described in the following.

The polymerizable monomer capable of forming the binder resin, the chain transfer agent represented by formula (3), and other optional additives, e.g., colorant, wax, and so forth, are dissolved or dispersed to uniformity using a disperser, e.g., a homogenizer, ball mill, colloid mill, or ultrasonic disperser, following by dissolution of the polymerization initiator thereinto to prepare a polymerizable monomer composition. The polymerizable monomer composition is then suspended in an aqueous medium containing a dispersion stabilizer to form liquid droplets of the polymerizable monomer composition. Toner particles are subsequently produced by carrying out the polymerization of the polymerizable monomer in these liquid droplets.

The polymerization initiator and chain transfer agent may be added at the same time as the addition of the other additives to the polymerizable monomer or may be admixed just before suspension in the aqueous medium. In addition, the polymerization initiator may be added, dissolved in the polymerizable monomer or a solvent, immediately after granulation and before initiation of the polymerization reaction.

The weight-average particle diameter (D4) of the toner particle is preferably at least 4.0 μm and not more than 9.0 μm, more preferably at least 5.0 μm and not more than 8.0 μm, and still more preferably at least 5.0 μm and not more than 7.0 μm.

The methods for calculating and measuring the various property values specified for the present invention are described in the following.

<Method for Measuring Molecular Weight of Wax>

The molecular weight of the wax is measured proceeding as follows using gel permeation chromatography (GPC).

Special grade 2,6-di-t-butyl-4-methylphenol (BHT) is added at a concentration of 0.10 mass/volume % to o-dichlorobenzene for gel chromatography and dissolution is performed at room temperature. The wax and this BHT-containing o-dichlorobenzene are introduced into a sample vial and heating is carried out on a hot plate set to 150° C. to dissolve the wax. Once the wax has dissolved, this is introduced into a preheated filter unit and is placed in the main unit. The material passing through the filter unit is used as the GPC sample. The sample solution is adjusted to a concentration of 0.15 mass %. The measurement is performed under the following conditions using this sample solution.

instrument: HLC-8121GPC/HT (Tosoh Corporation) detector: high-temperature RI
column: TSKgel GMHHR-H HT×2 (Tosoh Corporation)
temperature: 135.0° C.
solvent: o-dichlorobenzene for gel chromatography (with the addition of BHT at 0.10 mass/volume %)
flow rate: 1.0 mL/min
injection amount: 0.4 mL A molecular weight calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the wax.

<Method for Measuring Molecular Weight of Binder Resin>

The number-average molecular weight (Mn) and weight-average molecular weight (Mw) of the binder resin are measured as follows using gel permeation chromatography (GPC).

First, the binder resin is dissolved in tetrahydrofuran (THF) at room temperature. The obtained solution is filtered across a "Sample Pretreatment Cartridge" solvent-resistant membrane filter with a pore diameter of 0.2 μm (Tosoh Corporation) to obtain the sample solution. The sample solution is adjusted to a THF-soluble component concentration of 0.8 mass %. The measurement is performed under the following conditions using this sample solution.

instrument: "HLC-8220GPC" high-performance GPC instrument (Tosoh Corporation)
column: LF-604×2
eluent: THF
flow rate: 0.6 mL/min
oven temperature: 40° C. sample injection amount: 0.020 mL A molecular weight calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

<Method for Measuring Abundance of Main Chain Terminal Structures in Binder Resin>

The method for measuring the abundance (%) of main chain terminal structures in the binder resin will now be described. Because the main chain terminal structures are terminal groups having different mobilities and are keto group structures, an analytical method based on a known nuclear magnetic resonance spectroscopic method can be used. Specifically, $^{13}$C-NMR measurement is carried out using a cryoprobe-equipped AVANCE-600 FT-NMR (solvent used: deuterochloroform) from Bruker BioSpin.

Quantitation is performed using reverse-gated decoupling and using a sample solution provided by dissolving 100 mg of the sample in 0.7 mL of the solvent and adding 50 mM chromium (III) acetylacetonate as a relaxation reagent. Compositional analysis is carried out, and the terminal group abundance with respect to the individual monomer amount can be calculated from the integration ratio between the signal for the carbonyl carbon in the terminal keto group and, for example, other carbonyl carbon originating with, e.g., the acrylic structure in the polymer, or phenyl carbon originating with the styrene structure in the polymer.

On the other hand, the apparent molecular weight can be calculated from the monomer compositional ratio in the polymer on the assumption of 100% for the aforementioned terminal group abundance, and as a consequence the main chain terminal structure abundance can be calculated from the ratio between the apparent molecular weight and the number-average molecular weight.

In some instances the binder resin incorporated in the toner of the present invention may have a large average molecular weight, and the method for measuring the main chain terminal structure abundance in such instances is described in the following.

The target polymer is subjected to fractional precipitation using a good solvent/poor solvent mixed system or commercial preparative chromatography (preparative GPC), thereby obtaining for each of a plurality of molecular weights.

The molecular weights and molecular weight distribution of these fractions are measured by, for example, GPC, and, from among these, the above-described $^{13}$C-NMR measurement is performed on multiple samples having small molecular weights and the main chain terminal structure abundance is calculated for each sample. The main chain terminal structure abundance can be determined by taking the average of these main chain terminal structure abundances.

With regard to separation of the binder resin, wax, and so forth in the toner, compositional analysis of the toner is performed in order to estimate the type of binder resin, wax, fixing auxiliary agents, and so forth, and this is followed by extraction using a good solvent for each. Alternatively, fractions for each component are obtained by carrying out the aforementioned fractional precipitation or fractionation using preparative GPC. By analyzing these using known structural analysis methods (nuclear magnetic resonance spectroscopy, infrared spectroscopy, pyrolysis GC/MS, and so forth), the structure of each polymer, wax, and fixing auxiliary agent can be identified and the SP value and so forth can be calculated. In addition, the binder resin can be estimated from the abundance of each polymer species and the terminal group abundance can be determined using the previously described method for calculating the terminal group structure abundance.

<Method for Measuring Melting Point Tm of Wax>

The melting point Tm of the wax is measured based on ASTM D3418-82 using a "Q1000" differential scanning calorimeter (TA Instruments).

Temperature correction in the instrument detection section is performed using the melting points of indium and zinc, and the amount of heat is corrected using the heat of fusion of indium.

Specifically, 5 mg of the wax is exactly weighed out and this is introduced into an aluminum pan, and the measurement is run at a ramp rate of 10° C./min in the measurement temperature range between 30° C. and 200° C. using an empty aluminum pan as reference. The measurement is carried out by initially raising the temperature to 200° C., then cooling to 30° C. at 10° C./min, and then reheating at 10° C./min. The melting point Tm by DSC measurement is taken to be the maximum endothermic peak in the DSC curve in the 30° C. to 200° C. temperature range in this second ramp-up process.

<Method for Measuring Weight-Average Particle Diameter (D4) and Number-Average Particle Diameter (D1) of Toner>

Using a "Coulter Counter Multisizer 3" (registered trademark, Beckman Coulter, Inc.), a precision particle size distribution measurement instrument operating on the pore electrical resistance method and equipped with a 100 μm aperture tube, and the accompanying dedicated software, i.e., "Beckman Coulter Multisizer 3 Version 3.51" (Beckman Coulter, Inc.), for setting the measurement conditions and analyzing the measurement data, the weight-average particle diameter (D4) and the number-average particle diameter (D1) of the toner are determined by performing the measurement in 25,000 channels for the number of effective measurement channels and analyzing the measurement data.

The aqueous electrolyte solution used for the measurements is prepared by dissolving special-grade sodium chloride in deionized water to provide a concentration of 1 mass % and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to one time; and the Kd value is set to the value obtained using "standard particle 10.0 μm" (Beckman Coulter, Inc.). The threshold value and noise level are automatically set by pressing the threshold value/noise level measurement button. In addition, the current is set to 1600 μA; the gain is set to 2; the electrolyte is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to at least 2 μm and not more than 60 μm.

The specific measurement procedure is as follows.

(1) 200 mL of the above-described aqueous electrolyte solution is introduced into a 250-mL round-bottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) 30 mL of the above-described aqueous electrolyte solution is introduced into a 100-mL flat-bottom glass beaker. To this is added as dispersing agent 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) A prescribed amount of deionized water is introduced into the water tank of an "Ultrasonic Dispersion System Tetora 150" (Nikkaki Bios Co., Ltd.), which is an ultrasonic disperser with an electrical output of 120 W and equipped with two oscillators (oscillation frequency=50 kHz) disposed such that the phases are displaced by 180°, and 2 mL of Contaminon N is added to this water tank.

(4) The beaker described in (2) is set into the beaker holder opening on the ultrasonic disperser and the ultrasonic disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasonic, 10 mg of the toner is added to the aqueous electrolyte solution in small aliquots and dispersion is carried out. The ultrasonic dispersion treatment is continued for an additional 60 seconds. The water temperature in the water tank is controlled as appropriate during ultrasonic dispersion to be at least 10° C. and not more than 40° C.

(6) Using a pipette, the dispersed toner-containing aqueous electrolyte solution prepared in (5) is dripped into the round-bottom beaker set in the sample stand as described in (1) with adjustment to provide a measurement concentration of 5%. Measurement is then performed until the number of measured particles reaches 50,000.

(7) The particle diameters are calculated by analyzing the measurement data using the previously cited dedicated software provided with the instrument. When set to graph/volume % with the dedicated software, the "average diameter" on the analysis/volumetric statistical value (arithmetic average) screen is the weight-average particle diameter (D4), and when set to graph/number % with the dedicated software, the "average diameter" on the "analysis/numerical statistical value (arithmetic average)" screen is the number-average particle diameter (D1).

<Method for Measuring Polymerization Conversion>

The polymerization conversion is determined using the following method.

After completion of the polymerization reaction, a polymerization inhibitor is added to 1 g of the suspension, and this dissolved in 4 mL of THF is used to determine the polymerization conversion from the residual polymerizable monomer measured using gas chromatography under the following conditions and using the internal reference technique.

G.C. Conditions measurement instrument: GC-15A (capillary attached), Shimadzu Corporation carrier: $N_2$, 2 kg/cm$^2$, 50 mL/min, split 10 mL/13 s column: ULBON HR-150 m×0.25 mm temperature program:

hold 5 minutes at 50° C.

heat to 100° C. at 10° C./min heat to 200° C. at 20° C./min and hold sample amount: 2 μL reference substance: toluene

EXAMPLES

The present invention is specifically described below using examples, but the present invention is not limited to or by these examples.

<Production of Binder Resin 1>

The following materials were weighed into a reactor fitted with a condenser, stirrer, and nitrogen introduction line.

| | |
|---|---|
| styrene | 75.0 mass parts |
| n-butyl acrylate | 25.0 mass parts |
| α-benzyloxystyrene | 1.0 mass part |
| Perbutyl PV (NOF Corporation) | 7.0 mass parts |
| toluene | 100.0 mass parts |

Then, after stirring to uniformity, bubbling with nitrogen was carried out for 10 minutes followed by heating to 75° C. while under a nitrogen flow. A reaction was carried out for 6 hours; reprecipitation and purification were performed using methanol as the precipitating agent; and vacuum drying was performed to obtain binder resin 1.

The composition of the obtained binder resin was styrene: n-butyl acrylate=75:25 (mass ratio), and the solubility parameter $S_P$ derived from this compositional ratio was 9.8. The molecular weights of binder resin 1 as determined by GPC were a weight-average molecular weight (Mw) of 18,900 and a number-average molecular weight (Mn) of 13,100.

A main chain terminal structure of the binder resin was —CO-Ph, and the abundance of the terminal structure calculated by $^{13}$C-NMR was 12.5%. The properties of the obtained binder resin are given in Table 1-1.

<Production of Binder Resins 2 to 15>

Binder resins 2 to 15 were obtained by the same method as for binder resin 1, but changing the starting materials and number of parts of addition as shown in Table 1. The properties of each of the obtained binder resins are given in Tables 1-1 and 1-2.

Example 1

<Production of Toner 1>

| | |
|---|---|
| binder resin 1 | 100.0 mass parts |
| hydrocarbon wax (melting point = 78° C., Nippon Seiro Co., Ltd.) | 12.0 mass parts |
| copper phthalocyanine pigment (Pigment Blue 15:3) | 4.5 mass parts |
| negative-charging charge control agent (Bontron E-88, Orient Chemical Industries Co., Ltd.) | 0.3 mass parts |

These materials were thoroughly mixed using a Mitsui Henschel mixer ("Model FM-75", Mitsui Miike Chemical Engineering Machinery, Co., Ltd.), followed by kneading with a twin-screw kneader ("Model PCM-30", Ikegai Ironworks Corporation) set to a temperature of 130° C. The resulting kneaded material was cooled and coarsely pulverized to 1 mm and below using a hammer mill to obtain a coarsely pulverized material. The obtained coarsely pulverized material was finely pulverized using a collision-type gas current pulverizer using a high-pressure gas. Toner particles were then obtained by the simultaneous classification and removal of the fines and coarse powder by carrying out classification with a Coanda effect-based wind force classifier ("Elbow Jet Labo EJ-L3", Nittetsu Mining Co., Ltd.).

Toner 1 was obtained by mixing, using a Mitsui Henschel mixer, 100.0 mass parts of the obtained toner particle for 15 minutes at a mixing rate of 3,000 rpm with 1.5 mass parts of an external additive in the form of a hydrophobic silica fine powder (primary particle diameter: 7 nm, BET specific surface area: 300 m$^2$/g) provided by treating a silica fine powder with 20 mass % of dimethylsilicone oil. Toner 1 had a weight-average particle diameter (D4) of 5.9 μm. The properties of the obtained toner are given in Table 2-1.

Examples 2 to 17

<Production of Toners 2 to 17>

Toners 2 to 17 were obtained using the same production method as for toner 1, but changing the starting materials and number of parts of addition as shown in Table 2. The properties of each of the obtained toners are shown in Tables 2-1 and 2-2.

Example 18

<Production of Toner 18>

(Production of Core Resin Fine Particle Dispersion 1)

| | |
|---|---|
| binder resin 10 | 60.0 mass parts |
| anionic surfactant (Neogen RK, DKS Co., Ltd.) | 0.2 mass parts |
| N,N-dimethylaminoethanol | 1.9 mass parts |
| tetrahydrofuran | 200.0 mass parts |

These preceding were mixed and dissolved and were stirred at 4,000 rpm using a T. K. Robomix ultrahigh-speed stirrer (Primix Corporation). 177.80 mass parts of deionized water was also dripped in followed by removal of the tetrahydrofuran using an evaporator to obtain a core resin fine particle dispersion 1. Measurement of the volume-based particle diameter of the resin fine particles in the dispersion using a dynamic light-scattering particle size distribution analyzer (Nanotrac, Nikkiso Co., Ltd.) gave a result of 0.22 μm.

(Production of Shell Resin Fine Particle Dispersion 1)

| | |
|---|---|
| polyester resin A | 60.0 mass parts |
| anionic surfactant (Neogen RK, DKS Co., Ltd.) | 0.3 mass parts |
| N,N-dimethylaminoethanol | 1.9 mass parts |
| tetrahydrofuran (Polyester resin A is a polycondensate of terephthalic acid:isophthalic acid:propylene oxide-modified bisphenol A (2 mol adduct):ethylene oxide-modified bisphenol A (2 mol adduct) = 20:20:44:50 (mass ratio), with Mn: 3,200 and Mw: 7,000.) | 200.0 mass parts |

Using the preceding, a shell resin fine particle dispersion 1 was obtained by the same method as for the core resin fine particle dispersion. The volume-based particle diameter of the resin fine particles in the dispersion was 0.09 μm.

(Colorant Fine Particle Aqueous Dispersion)

| | |
|---|---|
| copper phthalocyanine pigment (Pigment Blue 15:3) | 100.0 mass parts |
| anionic surfactant (Neogen RK, DKS Co., Ltd.) | 15.0 mass parts |
| deionized water | 885.0 mass parts |

These preceding were mixed and were dispersed for 1 hour using a Nanomizer high-pressure impact-type disperser (Yoshida Kikai Co., Ltd.) to produce, through the dispersion of the colorant, an aqueous dispersion of colorant fine particles. Measurement of the volume-based particle diameter of the colorant fine particles in the colorant fine particle aqueous dispersion using a dynamic light-scattering particle size distribution analyzer gave a result of 0.20 μm.

(Release Agent Fine Particle Aqueous Dispersion)

| | |
|---|---|
| hydrocarbon wax (melting point = 78° C., Nippon Seiro Co., Ltd.) | 100.0 mass parts |
| anionic surfactant (Neogen RK, DKS Co., Ltd.) | 10.0 mass parts |
| deionized water | 880.0 mass parts |

The preceding were introduced into a stirrer-equipped mixing vessel and then heated to 90° C. and, while circulating to a Clearmix W-Motion (M Technique Co., Ltd.), stirring was carried out at a shear stirring unit having a rotor outside diameter of 3 cm and a clearance of 0.3 mm, under conditions of a rotor rotation rate of 19,000 rpm and a screen rotation rate of 19,000 rpm. After a 60 minute dispersion treatment, a release agent fine particle aqueous dispersion was obtained by cooling to 40° C. under cooling treatment conditions of a rotor rotation rate of 1,000 rpm, a screen rotation rate of 0 rpm, and a cooling rate of 10° C./min. Measurement of the volume-based particle diameter of the release agent fine particles in the release agent fine particle aqueous dispersion using a dynamic light-scattering particle size distribution analyzer gave a result of 0.15 μm.

(Production of Core Particle Dispersion)

| | |
|---|---|
| core resin fine particle dispersion 1 | 40.0 mass parts |
| colorant fine particle aqueous dispersion | 10.0 mass parts |
| release agent fine particle aqueous dispersion | 20.0 mass parts |
| 1 mass % aqueous magnesium sulfate solution | 20.0 mass parts |
| deionized water | 140.0 mass parts |

The preceding were dispersed using a homogenizer (Ultra-Turrax T50, IKA) followed by heating to 45° C. on a heating water bath while stirring with a stirring blade. After holding for 1 hour at 45° C., inspection with an optical microscope confirmed that aggregate particles having an average particle diameter of 5.5 μm had been formed. Core particle coalescence was induced by adding 40 mass parts of a 5 mass % aqueous trisodium citrate solution, heating to 85° C. while continuing to stir, and holding for 120 minutes.

Then, while continuing to stir, water was introduced into the water bath and cooling was carried out to 25° C. to obtain a core particle dispersion. Measurement of the particle diameter of the core particles in the core particle dispersion using a particle size distribution analyzer based on the Coulter method (Coulter Multisizer III, Beckman Coulter, Inc.) gave a weight-average particle diameter (D4) of 4.5 μm.

(Toner Particle Production)

1,000 mass parts of the core particle dispersion was placed in a tall beaker and was stirred with a stirring blade at 25° C. on a heating water bath. 113 mass parts of the shell resin fine particle dispersion was then added and stirring was carried out for 10 minutes. 200 mass parts of a 2 mass % aqueous calcium chloride solution was also gradually added dropwise. The dispersion at this stage is designated dispersion A.

While in this state, a small amount of the liquid was intermittently removed and passed through a 2-μm microfilter, and stirring was continued at 25° C. until the filtrate became transparent. After it had been confirmed that the filtrate had become transparent, the temperature was raised to 40° C.; 133 mass parts of a 5 mass % aqueous trisodium citrate solution was added; and the temperature was raised to 65° C. and stirring was carried out for 1.5 hours. The resulting liquid was then cooled to 25° C. followed by solid/liquid separation by filtration, addition to the solids of 800 mass parts of deionized water, and stirring for 30 minutes. This was followed by another solid/liquid separation by filtration. In order to eliminate the effects of residual surfactant, this filtration and washing was repeated until the electrical conductivity of the filtrate reached 150 μS/cm or less.

A toner particle 18 having a core/shell structure was then obtained by drying the resulting solids. The obtained core/shell-structured toner particle 18 had a weight-average particle diameter (D4) of 6.6 μm and it was thus judged that toner particles had been obtained without aggregation.

External addition was performed on the obtained toner particle 18 by the same method as for toner 1 to obtain toner 18. The properties of the obtained toner are given in Table 3.

Example 19

<Production of Toner 19>

| | |
|---|---|
| binder resin 1 | 100.0 mass parts |
| methyl ethyl ketone | 100.0 mass parts |
| ethyl acetate | 100.0 mass parts |
| hydrocarbon wax (melting point = 78° C., Nippon Seiro Co., Ltd.) | 12.0 mass parts |
| copper phthalocyanine pigment (Pigment Blue 15:3) | 6.5 mass parts |
| negative-charging charge control agent (Bontron E-88, Orient Chemical Industries Co., Ltd.) | 1.0 mass part |

Dispersion was carried out for 3 hours on these materials using an attritor (Mitsui Mining & Smelting Co., Ltd.) to obtain a colorant dispersion.

Otherwise, 27 mass parts of calcium phosphate was added to 3,000 mass parts of deionized water that had been heated to a temperature of 60° C. and stirring was carried out at a stirring rate of 10,000 rpm using a T. K. Homomixer (Tokushu Kika Kogyo Co., Ltd.) to obtain an aqueous medium. The aforementioned colorant dispersion was introduced into this aqueous medium and granulation into colorant particles was performed by stirring for 15 minutes at a stirring rate of 12,000 rpm using a T. K. Homomixer at a temperature of 65° C. under an $N_2$ atmosphere. The T. K. Homomixer was then changed over to an ordinary propeller stirrer and, with the stirring rate of the stirrer held at 150 rpm, the internal temperature was raised to 95° C. and holding was carried out for 3 hours to remove the solvent from the dispersion and thereby produce a toner particle dispersion. Hydrochloric acid was added to the resulting toner particle dispersion to bring the pH to 1.4 and the calcium phosphate salt was dissolved by stirring for 1 hour. The dispersion was then filtered and washed using a pressure filtration unit to obtain a toner aggregate. The toner aggregate was subsequently subjected to pulverization and drying to obtain toner particles.

A toner 19 was obtained by carrying out external addition on the obtained toner particles using the same procedure as for toner 1. The weight-average particle diameter (D4) of toner 19 was 6.0 μm. The properties of the obtained toner are given in Table 3.

Example 20

<Production of Toner 20>

9.0 mass parts of tricalcium phosphate was added to 1,300.0 mass parts of deionized water that had been heated to a temperature of 60° C. and stirring was carried out using a T. K. Homomixer at a stirring rate of 15,000 rpm to prepare an aqueous medium.

The following binder resin starting materials were also mixed while being stirred at a stirring rate of 100 rpm with a propeller-type stirrer to prepare a mixture.

| | |
|---|---|
| styrene | 75.0 mass parts |
| n-butyl acrylate | 25.0 mass parts |
| α-benzyloxystyrene | 1.5 mass parts |

Then

| | |
|---|---|
| copper phthalocyanine pigment (Pigment Blue 15:3) | 6.5 mass parts |
| negative-charging charge control agent (Bontron E-88, Orient Chemical Industries Co., Ltd.) | 0.5 mass parts |
| hydrocarbon wax (melting point = 78° C.) | 12.0 mass parts |

were added to the aforementioned solution and, after the mixture had been heated to a temperature of 70° C., stirring, dissolution, and dispersion were carried out using a T. K. Homomixer at a stirring rate of 10,000 rpm to prepare a polymerizable monomer composition.

This polymerizable monomer composition was subsequently introduced into the aforementioned aqueous medium;

| | |
|---|---|
| Perbutyl PV | 7.0 mass parts |

was added as polymerization initiator; and granulation was carried out by stirring for 20 minutes at a temperature of 70° C. at a stirring rate of 15,000 rpm using a T. K. Homomixer.

After transfer to a propeller-type stirrer, a polymerization reaction was run between the styrene and n-butyl acrylate, which were the polymerizable monomers in the polymerizable monomer composition, for 5 hours at a temperature of 85° C. while stirring at a stirring rate of 200 rpm, to produce a toner particle-containing slurry. The slurry was cooled after the completion of the polymerization reaction. Hydrochloric acid was added to the cooled slurry to bring the pH to 1.4, and the calcium phosphate salt was dissolved by stirring for 1 hour. The slurry was then washed with 10-fold water followed by filtration and drying and then adjustment of the particle diameter by classification to yield toner particles. —CO-Ph was a main chain terminal structure in the binder resin, and the abundance of this terminal structure as calculated using $^{13}$C-NMR was 15.2%.

External addition was carried out on the obtained toner particles using the same method as for toner 1 to obtain toner 20. The weight-average particle diameter (D4) of toner 20 was 5.8 μm. The properties of the obtained toner are given in Table 3.

TABLE 1-1

| | | Binder resin 1 | Binder resin 2 | Binder resin 3 |
|---|---|---|---|---|
| Polymerizable monomer A | | Styrene | Styrene | Styrene |
| Amount (mass parts) | | 75 | 75 | 75 |
| Polymerizable monomer B | | n-butyl acrylate | n-butyl acrylate | n-butyl acrylate |
| Amount (mass parts) | | 25 | 25 | 25 |
| Polymerization initiator | | Perbutyl PV | Perbutyl PV | Perbutyl PV |
| Amount (mass parts) | | 7.0 | 3.0 | 10.0 |
| Additive | | α-benzyloxystyrene | α-benzyloxystyrene | α-benzyloxystyrene |
| Amount (mass parts) | | 1.0 | 3.6 | 0.6 |
| Solubility parameter Sp | | 9.8 | 9.8 | 9.8 |
| Molecular weight | Mn | 13100 | 8600 | 8400 |
| | Mw | 18900 | 13700 | 12200 |
| Main chain terminal group structure | | —CO—Ph | —CO—Ph | —CO—Ph |
| Abundance of main chain terminal group | | 12.5% | 73.3% | 5.8% |

| | Binder resin 4 | Binder resin 5 | Binder resin 6 |
|---|---|---|---|
| Polymerizable monomer A | Styrene | Styrene | Styrene |
| Amount (mass parts) | 75 | 75 | 75 |
| Polymerizable monomer B | n-butyl acrylate | n-butyl acrylate | n-butyl acrylate |
| Amount (mass parts) | 25 | 25 | 25 |
| Polymerization initiator | Perbutyl PV | Perbutyl PV | Perbutyl PV |
| Amount (mass parts) | 8.0 | 8.0 | 6.5 |
| Additive | α-benzyloxystyrene | Methyl 2-benzyloxyacrylate | t-butyloxystyrene |

TABLE 1-1-continued

| | | | | |
|---|---|---|---|---|
| Amount (mass parts) | | 0.2 | 1.0 | 1.0 |
| Solubility parameter Sp | | 9.8 | 9.8 | 9.8 |
| Molecular weight | Mn | 14200 | 13500 | 15200 |
| | Mw | 30500 | 18800 | 21000 |
| Main chain terminal group structure | | —CO—Ph | —CO—COOCH3 | —CO—Ph |
| Abundance of main chain terminal group | | 2.3% | 10.6% | 13.1% |

| | | Binder resin 7 | Binder resin 8 | Binder resin 9 |
|---|---|---|---|---|
| Polymerizable monomer A | | Styrene | Styrene | Styrene |
| Amount (mass parts) | | 75 | 75 | 75 |
| Polymerizable monomer B | | n-butyl acrylate | n-dodecyl acrylate | Ethyl acrylate |
| Amount (mass parts) | | 25 | 25 | 25 |
| Polymerization initiator | | Perbutyl PV | Perbutyl PV | Perbutyl PV |
| Amount (mass parts) | | 7.5 | 10.0 | 8.0 |
| Additive | | Isobutyloxystyrene | α-benzyloxystyrene | α-benzyloxystyrene |
| Amount (mass parts) | | 1.0 | 1.0 | 1.0 |
| Solubility parameter Sp | | 9.8 | 9.4 | 9.9 |
| Molecular weight | Mn | 15100 | 17500 | 12300 |
| | Mw | 20800 | 26600 | 17800 |
| Main chain terminal group structure | | —CO—Ph | —CO—Ph | —CO—Ph |
| Abundance of main chain terminal group | | 12.3% | 11.9% | 12.0% |

TABLE 1-2

| | | Binder resin 10 | Binder resin 11 | Binder resin 12 |
|---|---|---|---|---|
| Polymerizable monomer A | | Styrene | Styrene | Styrene |
| Amount (mass parts) | | 75 | 75 | 69 |
| Polymerizable monomer B | | n-butyl acrylate | n-butyl acrylate | n-butyl acrylate |
| Amount (mass parts) | | 24 | 24 | 23 |
| Polymerizable monomer C | | Acrylic acid | Methyl vinyl ketone | Methyl vinyl ketone |
| Amount (mass parts) | | 1.0 | 1.0 | 8 |
| Polymerization initiator | | Perbutyl PV | Perbutyl PV | Perbutyl PV |
| Amount (mass parts) | | 7.0 | 7.0 | 7.0 |
| Additive | | α-benzyloxystyrene | — | — |
| Amount (mass parts) | | 1.0 | — | — |
| Solubility parameter Sp | | 9.8 | 9.8 | 9.8 |
| Molecular weight | Mn | 14500 | 13300 | 13200 |
| | Mw | 21800 | 19400 | 19000 |
| Main chain terminal group structure | | —CO—Ph | No keto group | No keto group |
| Abundance of main chain terminal group | | 12.8% | 0.0% | 0.0% |

| | | Binder resin 13 | Binder resin 14 | Binder resin 15 |
|---|---|---|---|---|
| Polymerizable monomer A | | Styrene | Styrene | Styrene |
| Amount (mass parts) | | 75 | 75 | 50 |
| Polymerizable monomer B | | n-butyl acrylate | 2-hydroxyethyl methacrylate | Behenyl acrylate |
| Amount (mass parts) | | 25 | 25 | 50 |
| Polymerizable monomer C | | | | |
| Amount (mass parts) | | | | |
| Polymerization initiator | | Perbutyl PV | Perbutyl PV | Perbutyl PV |
| Amount (mass parts) | | 7.0 | 7.0 | 7.0 |
| Additive | | n-hexyl 2-benzyloxyacrylate | α-benzyloxystyrene | α-benzyloxystyrene |
| Amount (mass parts) | | 1.0 | 1.0 | 1.0 |
| Solubility parameter Sp | | 9.8 | 10.6 | 9.3 |
| Molecular weight | Mn | 14500 | 16800 | 15200 |
| | Mw | 21800 | 22500 | 22000 |
| Main chain terminal group structure | | —CO—COOC6H13 | —CO—Ph | —CO—Ph |
| Abundance of main chain terminal group | | 14.2% | 12.9% | 13.1% |

—Ph refers to the phenyl group in the tables.

TABLE 2-1

| | Toner 1 | Toner 2 | Toner 3 | Toner 4 |
|---|---|---|---|---|
| Binder resin | Binder resin 1 | Binder resin 1 | Binder resin 1 | Binder resin 1 |
| Amount (mass parts) | 100 | 100 | 100 | 100 |
| Wax | Hydrocarbon wax (melting point = 78° C.) | Hydrocarbon wax (melting point = 78° C.) | Hydrocarbon wax (melting point = 78° C.) | Behenyl behenate (melting point = 71° C.) |
| Amount (mass parts) | 12 | 1.2 | 40.0 | 12 |
| Content (mass %) | 10.3 | 1.1 | 27.6 | 10.3 |
| Molecular weight | 470 | 470 | 470 | 650 |

TABLE 2-1-continued

| | | | | |
|---|---|---|---|---|
| Solubility parameter Sp | 9.8 | 9.8 | 9.8 | 9.8 |
| Solubility parameter Sw | 8.3 | 8.3 | 8.3 | 8.6 |
| \|Sp − Sw\| | 1.5 | 1.5 | 1.5 | 1.2 |
| Weight-average particle diameter D4 (μm) | 5.9 | 5.5 | 5.8 | 6.2 |

| | Toner 5 | Toner 6 | Toner 7 | Toner 8 |
|---|---|---|---|---|
| Binder resin | Binder resin 1 | Binder resin 2 | Binder resin 3 | Binder resin 4 |
| Amount (mass parts) | 100 | 100 | 100 | 100 |
| Wax | Ethylene glycol dibehenate (melting point = 83° C.) | Hydrocarbon wax (melting point = 78° C.) | Hydrocarbon wax (melting point = 78° C.) | Hydrocarbon wax (melting point = 78° C.) |
| Amount (mass parts) | 12 | 12 | 12 | 12 |
| Content (mass %) | 10.3 | 10.3 | 10.3 | 10.3 |
| Molecular weight | 710 | 470 | 470 | 470 |
| Solubility parameter Sp | 9.8 | 9.8 | 9.8 | 9.8 |
| Solubility parameter Sw | 8.8 | 8.3 | 8.3 | 8.3 |
| \|Sp − Sw\| | 1.0 | 1.5 | 1.5 | 1.5 |
| Weight-average particle diameter D4 (μm) | 5.4 | 6.1 | 6.0 | 5.8 |

| | Toner 9 | Toner 10 | Toner 11 | Toner 12 |
|---|---|---|---|---|
| Binder resin | Binder resin 5 | Binder resin 6 | Binder resin 7 | Binder resin 8 |
| Amount (mass parts) | 100 | 100 | 100 | 100 |
| Wax | Hydrocarbon wax (melting point = 78° C.) | Hydrocarbon wax (melting point = 78° C.) | Hydrocarbon wax (melting point = 78° C.) | Hydrocarbon wax (melting point = 78° C.) |
| Amount (mass parts) | 12 | 12 | 12 | 12 |
| Content (mass %) | 10.3 | 10.3 | 10.3 | 10.3 |
| Molecular weight | 470 | 470 | 470 | 470 |
| Solubility parameter Sp | 9.8 | 9.8 | 9.8 | 9.4 |
| Solubility parameter Sw | 8.3 | 8.3 | 8.3 | 8.3 |
| \|Sp − Sw\| | 1.5 | 1.5 | 1.5 | 1.1 |
| Weight-average particle diameter D4 (μm) | 5.8 | 6.3 | 6.0 | 5.6 |

TABLE 2-2

| | Toner 13 | Toner 14 | Toner 15 | Toner 16 |
|---|---|---|---|---|
| Binder resin | Binder resin 9 | Binder resin 1 | Binder resin 1 | Binder resin 1 |
| Amount (mass parts) | 100 | 100 | 100 | 100 |
| Wax | Hydrocarbon wax (melting point = 78° C.) | Hydrocarbon wax (melting point = 78° C.) | Hydrocarbon wax (melting point = 78° C.) | Tripentaerythritol octabehenate (melting point = 76° C.) |
| Amount (mass parts) | 12 | 0.7 | 55 | 12 |
| Content (mass %) | 10.3 | 0.7 | 34.4 | 10.3 |
| Molecular weight | 470 | 470 | 470 | 2800 |
| Solubility parameter Sp | 9.9 | 9.8 | 9.8 | 9.8 |
| Solubility parameter Sw | 8.3 | 8.3 | 8.3 | 8.9 |
| \|Sp − Sw\| | 1.6 | 1.5 | 1.5 | 0.9 |
| Weight-average particle diameter D4 (μm) | 6.0 | 5.9 | 6.3 | 6.1 |

| | Toner 17 |
|---|---|
| Binder resin | Binder resin 1 |
| Amount (mass parts) | 100 |
| Wax | Dipentaerythritol hexabehenate (melting point = 86° C.) |
| Amount (mass parts) | 12 |
| Content (mass %) | 10.3 |
| Molecular weight | 2200 |
| Solubility parameter Sp | 9.8 |
| Solubility parameter Sw | 8.9 |
| \|Sp − Sw\| | 0.9 |
| Weight-average particle diameter D4 (μm) | 6.5 |

TABLE 3

| | Toner 18 | Toner 19 | Toner 20 |
|---|---|---|---|
| Polymerizable monomer A | | | Styrene |
| Amount (mass parts) | | | 75 |
| Polymerizable monomer B | | | n-butyl acrylate |
| Amount (mass parts) | | | 25 |
| Polymerization initiator | | | Perbutyl PV |
| Amount (mass parts) | | | 7.0 |
| Additive | | | α-benzyloxystyrene |
| Amount (mass parts) | | | 1.5 |
| Solubility parameter Sp | | | 9.8 |
| Molecular weight Mn | | | 8400 |
| Molecular weight Mw | | | 12200 |
| Main chain terminal group | —CO—Ph | —CO—Ph | —CO—Ph |
| Abundance of main chain terminal group | 12.5% | 12.5% | 15.2% |
| Binder resin | Binder resin 1 | Binder resin 1 | |
| Amount (mass parts) | 60 | | |
| Added resin | Polyester resin A | | |
| Amount (mass parts) | 40 | | |
| Wax | Hydrocarbon wax (melting point = 78° C.) | Hydrocarbon wax (melting point = 78° C.) | Hydrocarbon wax (melting point = 78° C.) |
| Amount (mass parts) | 10 | 12 | 12 |
| Content (mass %) | 8.7 | 10.0 | 10.3 |
| Molecular weight | 470 | 470 | 470 |
| Solubility parameter Sp | 9.8 | 9.8 | 9.8 |
| Solubility parameter Sw | 8.3 | 8.3 | 8.3 |
| \|Sp − Sw\| | 1.5 | 1.5 | 1.5 |
| weight-average particle diameter D4 (μm) | 6.6 | 6.0 | 5.8 |

Comparative Examples 1 to 8

<Production of Toners 21 to 28>

Toners 21 to 28 were obtained by the same production method as for toner 1, but changing the starting materials and number of parts of addition as shown in Table 4. The properties of each of the toners are shown in Table 4.

(Evaluations)

Each of the obtained toners was subjected to a property evaluation using the following methods.

A modified LBP-7700C (Canon, Inc.) was used as the image-forming apparatus and image evaluations were carried out. The LBP7700C was modified as follows.

TABLE 4

| | Toner 21 | Toner 22 | Toner 23 | Toner 24 |
|---|---|---|---|---|
| Binder resin | Binder resin 11 | Binder resin 12 | Binder resin 8 | Binder resin 1 |
| Amount (mass parts) | 100 | 100 | 100 | 100 |
| Wax | Hydrocarbon wax (melting point = 78° C.) | Hydrocarbon wax (melting point = 78° C.) | Dipentaerythritol hexapalmitate (melting point = 73° C.) | Dibehenyl terephthalate (melting point = 89° C.) |
| Amount (mass parts) | 12 | 12 | 12 | 12 |
| Content (mass %) | 10.3 | 10.3 | 10.3 | 10.3 |
| Molecular weight | 470 | 470 | 1690 | 780 |
| Solubility parameter Sp | 9.8 | 9.8 | 9.4 | 9.8 |
| Solubility parameter Sw | 8.3 | 8.3 | 9.0 | 9.1 |
| \|Sp − Sw\| | 1.5 | 1.5 | 0.4 | 0.7 |
| Weight-average particle diameter D4 (μm) | 5.9 | 5.7 | 6.2 | 6.0 |

| | Toner 25 | Toner 26 | Toner 27 | Toner 28 |
|---|---|---|---|---|
| Binder resin | Binder resin 1 | Binder resin 13 | Binder resin 14 | Binder resin 15 |
| Amount (mass parts) | 100 | 100 | 100 | 100 |
| Wax | Stearamide (melting point = 101° C.) | Hydrocarbon wax (melting point = 78° C.) | Hydrocarbon wax (melting point = 78° C.) | Hydrocarbon wax (melting point = 78° C.) |
| Amount (mass parts) | 12 | 12 | 12 | 12 |
| Content (mass %) | 10.3 | 10.3 | 10.3 | 10.3 |
| Molecular weight | 900 | 470 | 470 | 470 |
| Solubility parameter Sp | 9.8 | 9.8 | 10.6 | 9.3 |
| Solubility parameter Sw | 9.9 | 8.3 | 8.3 | 8.3 |
| \|Sp − Sw\| | 0.1 | 1.5 | 2.3 | 1.0 |
| Weight-average particle diameter D4 (μm) | 5.8 | 5.9 | 6.7 | 6.3 |

The process speed was made freely settable by altering the gearing and software of the main unit of the machine used for the evaluation.

The cyan cartridge was used as the cartridge used for the evaluation. Thus, the commercial toner was removed from the commercial cyan cartridge; the interior was cleaned with an air blower; and 200 g of the toner that had been produced was filled thereinto. The commercial toner was removed at each of the magenta, yellow, and black stations, and the magenta, yellow, and black cartridges were inserted with the detection mechanism for the residual amount of toner disabled.

The fixing unit was altered to make the fixation temperature manually settable.

<Hot Offset Resistance>

Operating in a normal-temperature, normal-humidity environment (temperature 23° C., 50% relative humidity), an image having a large number of 10 mm×10 mm solid images for the purpose of density measurement and adjusted to have a toner mass per unit area of 0.70 mg/cm$^2$, was output at the center of the leading edge of A4 plain copier paper (75 g/m$^2$). The hot offset occurrence temperature was taken to be the temperature of the surface of the heated fixing unit when hot offset (a phenomenon in which a portion of the fixed image is attached to the surface of a member of the fixing unit and is also fixed onto the recording material in an ensuing rotation) was produced at the back end, in the paper transport direction, of the recording material during passage through the fixing unit, and the hot offset occurrence temperature was evaluated based on the following evaluation criteria. The image was output at a process speed of 100 mm/sec.

A: at least 200° C.

B: at least 195° C. and less than 200° C.

C: at least 190° C. and less than 195° C.

D: at least 180° C. and less than 190° C.

E: less than 180° C.

<Fogging in High-Temperature, High-Humidity Environment (Temperature 32.5° C., 80% Relative Humidity)>

Operating in a high-temperature, high-humidity environment (temperature 32.5° C., 80% relative humidity), an image having a white background region was output using A4 color laser copy paper (Canon, Inc., 80 g/m$^2$) for the evaluation paper. Using a digital brightness meter (Model TC-6D, Tokyo Denshoku Co., Ltd., an amber filter was used), the reflectance (%) of the white background region of the output image was measured at each of five points and the average value was determined. The reflectance (%) of the white background region of the evaluation paper prior to output was similarly measured, and the image fogging (%) was taken to be the difference between the two average reflectance (%) values.

A lower image fogging difference (%) here indicated a toner with a better charging stability.

A: The image fogging difference (%) pre-versus-post-output is less than 0.5%.

B: The image fogging difference (%) pre-versus-post-output is at least 0.5% and less than 1.0%.

C: The image fogging difference (%) pre-versus-post-output is at least 1.0% and less than 1.5%.

D: The image fogging difference (%) pre-versus-post-output is at least 1.5% and less than 2.0%.

E: The image fogging difference (%) pre-versus-post-output is at least 2.0%.

The results of the property evaluations of the toners are given in Table 5.

TABLE 5

| | | Hot offset resistance | Fogging in a high-temperature, high-humidity environment |
|---|---|---|---|
| Example 1 | Toner 1 | A(210° C.) | A(0.3%) |
| Example 2 | Toner 2 | B(195° C.) | A(0.3%) |
| Example 3 | Toner 3 | A(208° C.) | A(0.3%) |
| Example 4 | Toner 4 | A(205° C.) | B(0.5%) |
| Example 5 | Toner 5 | A(203° C.) | B(0.6%) |
| Example 6 | Toner 6 | A(210° C.) | C(1.4%) |
| Example 7 | Toner 7 | B(195° C.) | A(0.2%) |
| Example 8 | Toner 8 | C(190° C.) | A(0.2%) |
| Example 9 | Toner 9 | A(210° C.) | A(0.3%) |
| Example 10 | Toner 10 | A(210° C.) | A(0.3%) |
| Example 11 | Toner 11 | A(210° C.) | A(0.3%) |
| Example 12 | Toner 12 | A(203° C.) | A(0.3%) |
| Example 13 | Toner 13 | A(210° C.) | C(1.2%) |
| Example 14 | Toner 14 | C(190° C.) | A(0.3%) |
| Example 15 | Toner 15 | B(198° C.) | C(1.0%) |
| Example 16 | Toner 16 | C(190° C.) | C(1.2%) |
| Example 17 | Toner 17 | A(208° C.) | B(0.6%) |
| Example 18 | Toner 18 | A(210° C.) | A(0.3%) |
| Example 19 | Toner 19 | A(210° C.) | A(0.3%) |
| Example 20 | Toner 20 | A(210° C.) | A(0.3%) |
| Comparative Example 1 | Toner 21 | D(183° C.) | A(0.3%) |
| Comparative Example 2 | Toner 22 | B(198° C.) | D(1.8%) |
| Comparative Example 3 | Toner 23 | D(180° C.) | A(0.4%) |
| Comparative Example 4 | Toner 24 | D(183° C.) | C(1.2%) |
| Comparative Example 5 | Toner 25 | E(170° C.) | C(1.4%) |
| Comparative Example 6 | Toner 26 | D(185° C.) | A(0.3%) |
| Comparative Example 7 | Toner 27 | B(198° C.) | E(2.3%) |
| Comparative Example 8 | Toner 28 | E(a fixable range did not found) | A(0.3%) |

The chain transfer agents used in the examples and comparative examples are given in Table 6.

TABLE 6

| | Chain transfer agent 1 | Chain transfer agent 2 | Chain transfer agent 3 | Chain transfer agent 4 | Chain transfer agent 5 | Chain transfer agent 6 | Chain transfer agent 7 |
|---|---|---|---|---|---|---|---|
| Structure | 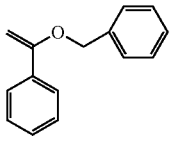 | 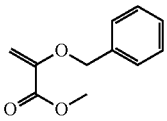 | 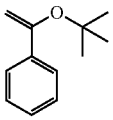 | 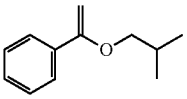 | 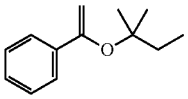 | 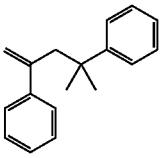 | n-dodecyl mercaptan |

TABLE 6-continued

| | Chain transfer agent 1 | Chain transfer agent 2 | Chain transfer agent 3 | Chain transfer agent 4 | Chain transfer agent 5 | Chain transfer agent 6 | Chain transfer agent 7 |
|---|---|---|---|---|---|---|---|
| Designation | α-BnOSt | MBnOA | t-BuOSt | i-BuOSt | t-AmOMMA | MSD | DDM |

Example 101

9.0 mass parts of tricalcium phosphate was added to 1,300.0 mass parts of deionized water that had been heated to a temperature of 60° C., and stirring was carried out at a stirring rate of 15,000 rpm using a T. K. Homomixer (Tokushu Kika Kogyo Co., Ltd.) to prepare an aqueous medium.

In addition, while stirring at a stirring rate of 100 rpm with a propeller-type stirrer, the following binder resin starting materials were mixed to prepare a mixture.

| | |
|---|---|
| styrene | 75.0 mass parts |
| n-butyl acrylate | 25.0 mass parts |
| α-BnOSt (α-benzyloxystyrene) | 2.0 mass parts |

Then

| | |
|---|---|
| cyan colorant (C. I. Pigment Blue 15:3) | 6.5 mass parts |
| negative-charging charge control agent (Bontron E-88, Orient Chemical Industries Co., Ltd.) | 0.5 mass parts |
| hydrocarbon wax (Tm = 78° C.) | 9.0 mass parts |

were added and, after the mixture had been heated to a temperature of 70° C., stirring, dissolution, and dispersion were carried out using a T. K. Homomixer at a stirring rate of 10,000 rpm to prepare a polymerizable monomer composition.

This polymerizable monomer composition was subsequently introduced into the aforementioned aqueous medium;

Perbutyl PV 7.0 mass parts (10-hour half-life temperature=54.6° C. (NOF Corporation)) was added as polymerization initiator; and granulation was carried out by stirring for 20 minutes at a temperature of 70° C. at a stirring rate of 15,000 rpm using a T. K. Homomixer.

After changeover to a propeller-type stirrer, a polymerization reaction was run between the styrene and n-butyl acrylate, which were the polymerizable monomers in the polymerizable monomer composition, for 5 hours at a temperature of 85° C. while stirring at a stirring rate of 200 rpm, to produce a toner particle-containing slurry. The slurry was cooled after the completion of the polymerization reaction. Hydrochloric acid was added to the cooled slurry to bring the pH to 1.4, and the calcium phosphate salt was dissolved by stirring for 1 hour. The slurry was then washed with 10-fold water followed by filtration and drying and then adjustment of the particle diameter by classification to yield toner particles.

Toner 101 was obtained by mixing, using a Mitsui Henschel mixer (Mitsui Miike Chemical Engineering Machinery, Co., Ltd.), 100.0 mass parts of the obtained toner particle for 15 minutes at a stirring rate of 3,000 rpm with 1.5 mass parts of an external additive in the form of hydrophobic silica fine particles (primary particle diameter: 7 nm, BET specific surface area: 130 $m^2/g$) provided by treating silica fine particles with 20 mass % of dimethylsilicone oil. The results of its evaluation are given in Table 8.

<Production for Examples 102 to 112>

Toners 102 to 112 were obtained using the same production method as for toner 101, but changing the starting materials and the number of parts of addition as shown in Tables 7-1 and 7-2. The results of their evaluation are given in Table 8.

<Production for Comparative Example 101>

Toner 113 was produced by the same method as for toner 101, but changing the starting materials and number of parts of addition as shown in Table 7-2; however, the conversion was not raised and a toner product was not obtained.

<Production for Comparative Examples 102 to 105>

Toners 114 to 117 were obtained by the same method as for toner 101, but changing the starting materials and number of parts of addition as shown in Table 7-2. The results of their evaluation are given in Table 8.

TABLE 7-1

| | | Toner 101 | Toner 102 | Toner 103 | Toner 104 | Toner 105 |
|---|---|---|---|---|---|---|
| Resin | Polymerizable monomer 1 | St (styrene) 75.0 | St 75.0 | St 75.0 | St 75.0 | St 75.0 |
| | Polymerizable monomer 2 | BA (butyl acrylate) 25.0 | BA 25.0 | BA 25.0 | BA 25.0 | BA 25.0 |
| Polymerization initiator | | Perbutyl PV Peroxyester 7.0 | Perbutyl PV Peroxyester 7.0 | Perbutyl PV Peroxyester 7.0 | Perbutyl PV Peroxyester 7.0 | Perbutyl PV Peroxyester 7.0 |
| Chain transfer agent | | Chain transfer agent 1 α-BnOSt 2.0 | Chain transfer agent 2 BnOMMA 2.0 | Chain transfer agent 3 t-BuOSt 2.0 | Chain transfer agent 3 t-BuOSt 0.2 | Chain transfer agent 3 t-BuOSt 0.3 |
| Molecular weight | Mw | 18000 | 19000 | 20000 | 22000 | 25000 |
| | Mw/Mn | 1.7 | 1.9 | 1.8 | 2.2 | 2.1 |

TABLE 7-1-continued

| | | Toner 106 | Toner 107 | Toner 108 | Toner 109 | Toner 110 |
|---|---|---|---|---|---|---|
| Resin | Polymerizable monomer 1 | St 75 | St 75 | St 75 | St 75 | St 75 |
| | Polymerizable monomer 2 | BA 25 | BA 25 | BA 25 | BA 25 | BA 25 |
| Polymerization initiator | | Perbutyl PV Peroxyester 7.0 | Perbutyl PV Peroxyester 7.0 | Perbutyl PV Peroxyester 7.0 | Peroyl 355 Diacyl peroxide 10.0 | OTAZO-15 Azo compound 7.0 |
| Chain transfer agent | | Chain transfer agent 3 t-BuOSt 0.5 | Chain transfer agent 3 t-BuOSt 4.5 | Chain transfer agent 3 t-BuOSt 5.5 | Chain transfer agent 3 t-BuOSt 2.0 | Chain transfer agent 3 t-BuOSt 2.0 |
| Molecular weight | Mw | 21000 | 12000 | 10000 | 19000 | 19000 |
| | Mw/Mn | 2.0 | 1.5 | 1.3 | 1.8 | 1.8 |

TABLE 7-2

| | | Toner 111 | Toner 112 | Toner 113 | Toner 114 | Toner 115 |
|---|---|---|---|---|---|---|
| Resin | Polymerizable monomer 1 | St 75 | St 75 | St 75 | St 75 | St 75 |
| | Polymerizable monomer 2 | BA 25 | BA 25 | BA 25 | BA 25 | BA 25 |
| Polymerization initiator | | Perbutyl PV Peroxyester 7.0 | Perbutyl PV Peroxyester 7.0 | Perbutyl PV Peroxyester 7.0 | Perbutyl PV Peroxyester 7.0 | Perbutyl PV Peroxyester 7.0 |
| Chain transfer agent | | Chain transfer agent 4 i-BuOSt 2.0 | Chain transfer agent 5 t-AmOMMA 2.0 | Chain transfer agent 6 MSD 2.0 | Chain transfer agent 6 MSD 0.5 | Chain transfer agent 7 DDM 2.0 |
| Molecular weight | Mw | 18000 | 21000 | 20000 | 48000 | 40000 |
| | Mw/Mn | 2.3 | 2.5 | 2.0 | 3.2 | 2.5 |

| | | Toner 116 | Toner 117 |
|---|---|---|---|
| Resin | Polymerizable monomer 1 | St 75 | St 75 |
| | Polymerizable monomer 2 | BA 25 | BA 25 |
| Polymerization initiator | | Perbutyl PV Peroxyester 7.0 | Perbutyl PV Peroxyester 7.0 |
| Chain transfer agent | | Chain transfer agent 7 DDM 0.5 | None — — |
| Molecular weight | Mw | 50000 | 47000 |
| | Mw/Mn | 3.4 | 3.2 |

[Evaluations]

<Evaluation of Polymerization Conversion>

The polymerization conversion was calculated as described above and was evaluated using the following criteria.

(Evaluation Criteria)

A: the conversion is at least 99.0%

B: the conversion is at least 98.0% and less than 99.0%

C: the conversion is at least 96.0% and less than 98.0%

D: the conversion is less than 96.0%

<Evaluation of Odor>

The toner odor was evaluated using the following method.

100 g of the toner was filled into a 250-cc plastic bottle, which was sealed with a lid and held for 2 days. A sensory evaluation of the presence/absence of odor was subsequently carried out upon opening. The presence/absence of odor was evaluated, using a 10-person evaluation panel, as the number of individuals perceiving odor.

<Evaluation of Low-Temperature Fixation>

The low-temperature fixation was evaluated using a partially modified "HP Color LaserJet 3525dn" commercial color laser printer. One modification enabled operation with the installation of a process cartridge for only one color. Another modification enabled the temperature of the fixing unit to be freely settable.

The toner present in the cyan toner process cartridge mounted in this color laser printer was removed therefrom; the interior was cleaned with an air blower; the particular toner was introduced into the process cartridge; the process cartridge loaded with the replacement toner was mounted in the color laser printer; and a fixation/rubbing test was performed at a fixing unit temperature of 160° C.

Operating in a normal-temperature, normal-humidity environment (temperature 23° C., 50% relative humidity), and with the toner laid-on level on the transfer material adjusted to 0.5 mg/cm$^2$, 50 prints were output of an image having a 10 mm×10 mm image for density measurement at nine points, i.e., three points vertical×three points horizontal.

The 50th fixed image thereby obtained was rubbed five times with lens-cleaning paper loaded with 50 g/cm$^2$, and the evaluation was carried out as indicated below using the percentage decline in the image density after rubbing. A MacBeth reflection densitometer (GretagMacbeth GmbH) was used to measure the image density; the relative density was measured with respect to the printed-out image of a white background region for which the original density was 0.00; and the percentage decline in the image density post-rubbing was calculated and evaluated. Plain paper (Xerox 4200 paper, letter size, Xerox Corporation, 75 g/m$^2$) was used for the transfer material.

(Evaluation Criteria)

A: the percentage decline in the image density is less than 1.0%

B: the percentage decline in the image density is at least 1.0% and less than 3.0%

C: the percentage decline in the image density is at least 3.0% and less than 5.0%

D: the percentage decline in the image density is at least 5.0%

TABLE 8

| | | Conversion | Odor | Fixing performance |
|---|---|---|---|---|
| Example 101 | Toner 101 | A(99.9%) | absent | A(0.5) |
| Example 102 | Toner 102 | A(99.9%) | absent | A(0.8) |
| Example 103 | Toner 103 | A(99.6%) | absent | A(0.7) |
| Example 104 | Toner 104 | A(99.9%) | absent | C(3.2) |
| Example 105 | Toner 105 | A(99.7%) | absent | B(2.2) |
| Example 106 | Toner 106 | A(99.7%) | absent | A(0.8) |
| Example 107 | Toner 107 | A(99.1%) | absent | A(0.5) |
| Example 108 | Toner 108 | B(98.4%) | absent | A(0.3) |
| Example 109 | Toner 109 | A(99.9%) | absent | A(0.7) |
| Example 110 | Toner 110 | A(99.9%) | absent | A(0.8) |
| Example 111 | Toner 111 | B(98.5%) | absent | B(1.4) |
| Example 112 | Toner 112 | B(98.1%) | absent | C(3.5) |
| Comparative Example 101 | Toner 113 | D(88.5%) | could not be evaluated | could not be evaluated |
| Comparative Example 102 | Toner 114 | B(98.4%) | absent | D(7.2) |
| Comparative Example 103 | Toner 115 | A(99.7%) | present (10 individuals) | B(1.8) |
| Comparative Example 104 | Toner 116 | A(99.9%) | present (8 individuals) | D(5.8) |
| Comparative Example 105 | Toner 117 | A(99.9%) | absent | D(7.2) |

The first aspect of the present invention provides a toner that exhibits an excellent hot offset resistance and that also exhibits an excellent charging stability in high-temperature, high-humidity environments.

The second aspect of the present invention provides a method of producing an odor-inhibited toner wherein a binder resin having a regulated molecular weight is obtained without a reduction in the conversion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-002749, filed, Jan. 11, 2017, Japanese Patent Application No. 2017-237606, filed, Dec. 12, 2017, which are hereby incorporated by reference herein in their entirety.

What is claimed is:

1. A toner comprising a toner particle that contains a binder resin and a wax, wherein the solubility parameter $S_P$ of the binder resin is at least 9.4 and not more than 10.0, the binder resin contains a resin having a structure represented by the following formula (1) in the terminal position on a main chain of the resin, $$*—CO—R \qquad \text{formula (1)}$$

wherein in formula (1), R represents a phenyl group or a derivative thereof, or —COOR$_1$, R$_1$ represents an alkyl group having 1 to 4 carbons, and * represents a bond to the main chain of the resin, the solubility parameter $S_W$ of the wax is at least 8.1 and not more than 9.0, and $S_P$ and $S_W$ satisfy formula (2).

$$|S_P - S_W| > 0.5 \qquad \text{formula (2)}$$

2. The toner according to claim 1, wherein the molecular weight of the wax is not more than 2,500.

3. The toner according to claim 1, wherein the binder resin contains a vinyl resin.

4. The toner according to claim 1, wherein the content of the wax in the toner particle is at least 1 mass % and not more than 30 mass %.

5. The toner according to claim 1, wherein the abundance of the structure represented by formula (1) in the binder resin is at least 5% and not more than 100%.

6. A method of producing the toner according to claim 1, the method comprising the step of obtaining the binder resin by polymerizing a polymerizable monomer composition containing:

a polymerization initiator;

a polymerizable monomer; and a vinyl ether addition-fragmentation chain transfer agent represented by formula (3);

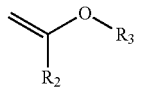

(3)

wherein in formula (3), R$_2$ represents —COOR$_1$ or a phenyl group or a derivative thereof, R$_1$ represents an alkyl group having 1 to 4 carbons, and R$_3$ represents a benzyl group or a secondary or tertiary alkyl group having 4 to 8 carbons.

7. A method of producing a toner having a toner particle that contains a binder resin, the method comprising the steps of:

dispersing, in an aqueous medium, a polymerizable monomer composition containing a chain transfer agent, a polymerization initiator, and a polymerizable monomer capable of forming the binder resin, to form a liquid droplet of the polymerizable monomer composition; and producing a toner particle by polymerizing the polymerizable monomer in the liquid droplet, wherein the polymerizable monomer contains at least one selected from the group consisting of styrene, acrylate esters, and methacrylate esters, and the chain transfer agent is a vinyl ether addition-fragmentation chain transfer agent represented by formula (3)

(3)

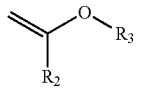

wherein in formula (3), $R_2$ represents —$COOR_1$ or a phenyl group or a derivative thereof, $R_1$ represents an alkyl group having 1 to 4 carbons, and $R_3$ represents a benzyl group or a secondary or tertiary alkyl group having 4 to 8 carbons.

8. The toner production method according to claim 7, wherein the amount of addition of the chain transfer agent is at least 0.1 mass parts and not more than 5.0 mass parts per 100.0 mass parts of the polymerizable monomer.

9. The toner production method according to claim 7, wherein the polymerization initiator is an alkyl peroxyester organoperoxide, a diacyl peroxide organoperoxide, or an azo compound.

10. The toner production method according to claim 7, wherein $R_2$ in formula (3) is —$COOCH_3$ or a phenyl group or a derivative thereof, and $R_3$ is a benzyl group, isobutyl group, or tert-butyl group.

11. The toner production method according to claim 7, wherein the chain transfer agent is at least one selected from the group consisting of formulas (4) to (6).

(4)

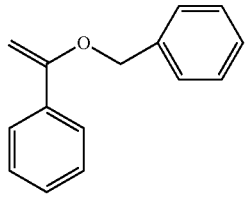

(5)

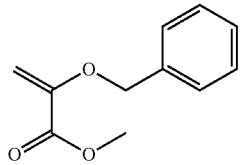

(6)

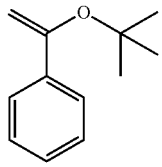

* * * * *